US010315787B2

(12) United States Patent
Luczak

(10) Patent No.: US 10,315,787 B2
(45) **Date of Patent: *Jun. 11, 2019**

(54) MANUAL CHECK VALVE FOR PRIMING A COLLAPSIBLE FLUID LINER FOR A SPRAYER

(71) Applicant: Graco Minnesota Inc., Minneapolis, MN (US)

(72) Inventor: Mariusz J. Luczak, Elk River, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/727,973

(22) Filed: Oct. 9, 2017

(65) Prior Publication Data

US 2018/0282000 A1 Oct. 4, 2018

Related U.S. Application Data

(63) Continuation of application No. 14/656,138, filed on Mar. 12, 2015, now Pat. No. 9,796,492.

(51) Int. Cl.
*B65B 7/28* (2006.01)
*B05B 3/00* (2006.01)
(Continued)

(52) U.S. Cl.
CPC ..... *B65B 7/2821* (2013.01); *B05B 3/006* (2013.01); *B05B 9/01* (2013.01); *B05B 9/0861* (2013.01);
(Continued)

(58) Field of Classification Search
CPC ..... B05B 3/006; B05B 15/628; B05B 15/14; B05B 9/01; B05B 9/0861; B65B 7/2821
(Continued)

(56) References Cited

U.S. PATENT DOCUMENTS 235,101 A 12/1880 Ryan
1,101,506 A 6/1914 Bradford
(Continued)

FOREIGN PATENT DOCUMENTS

CN 101678378 A 3/2010
DE 3432253 A1 3/1986
(Continued)

OTHER PUBLICATIONS

International Preliminary Report on Patentability, for PCT Patent Application No. PCT/US2012/061859, dated Apr. 29, 2014, 6 pages.
(Continued)

*Primary Examiner* — Steven J Ganey
(74) *Attorney, Agent, or Firm* — Kinney & Lange, P.A.

(57) ABSTRACT

A manual check valve for use when priming a fluid supply for a spray gun includes an orifice that opens from the fluid supply into a storage chamber, the storage chamber captures any fluid that is expelled from the fluid supply during priming, and the storage chamber is sealed with a closure. Sealing the storage chamber traps any expelled fluid in the storage chamber and prevents any of the expelled fluid from leaking onto another surface, which keeps the priming operation clean.

19 Claims, 6 Drawing Sheets

(51) Int. Cl.

| | |
|---|---|
| ***B05B 15/628*** | (2018.01) |
| ***B05B 9/01*** | (2006.01) |
| ***B05B 9/08*** | (2006.01) |
| ***B05B 15/14*** | (2018.01) |
| *B05B 7/24* | (2006.01) |

(52) U.S. Cl.
CPC ..... *B05B 15/14* (2018.02); *B05B 15/628* (2018.02); *B05B 7/2481* (2013.01)

(58) Field of Classification Search
USPC .... 239/302, 327, 328, 332, 345, 346, 533.1, 239/570
See application file for complete search history.

(56) References Cited

U.S. PATENT DOCUMENTS 1,352,102 A 9/1920 Tatro
1,422,371 A 7/1922 Page
1,468,226 A 9/1923 Colburn et al.
2,009,606 A 7/1935 Diffenderfer
2,123,358 A 7/1938 Grutzner
2,182,063 A 12/1939 Steiner
2,339,741 A 1/1944 Cartwright
2,394,487 A 2/1946 Rotter et al.
2,524,820 A 10/1950 Miles
2,631,892 A 3/1953 Czarnecki, Jr. et al.
2,637,194 A 5/1953 Pietri
2,639,194 A 5/1953 Wahlin
2,664,312 A 12/1953 Czarnecki, Jr. et al.
2,705,663 A 4/1955 Gilbreath
2,775,094 A 12/1956 Buckland et al.
2,791,451 A 5/1957 Rostan
2,840,989 A 7/1958 Macaulay
2,858,851 A 11/1958 Holl
2,875,782 A 3/1959 Lee
2,919,726 A 1/1960 Zimmermann et al.
2,967,112 A 1/1961 Kay et al.
2,994,344 A 8/1961 Kerley
2,998,828 A 9/1961 Hare
3,009,606 A 11/1961 Zimmermann
3,012,900 A 12/1961 Kleinmann et al.
3,065,918 A 11/1962 Hostetter
3,156,452 A 11/1964 Touzalin et al.
3,317,141 A 5/1967 Mann
3,347,205 A 10/1967 Dobbyn
3,363,806 A 1/1968 Blakeslee et al.
3,401,842 A 9/1968 Morrison
3,408,876 A 11/1968 Andrews
3,432,104 A * 3/1969 Kaltenbach ..... B05B 7/2408 239/328
3,457,957 A 7/1969 Mueller
3,507,686 A 4/1970 Magenbach
3,530,893 A 9/1970 Masuda
3,558,052 A 1/1971 Dunn
3,630,484 A 12/1971 Taylor
3,678,959 A 7/1972 Liposky
3,684,253 A 8/1972 Bevan
3,708,118 A 1/1973 Keur
3,747,899 A 7/1973 Latinen et al.
3,752,400 A 8/1973 Calder
3,763,891 A 10/1973 Stiltner
3,789,954 A 2/1974 Raleigh
3,805,833 A 4/1974 Teed
3,856,273 A 12/1974 Born
3,889,881 A 6/1975 Cunningham et al.
3,937,923 A 2/1976 Smith
4,018,143 A 4/1977 Dice, Jr. et al.
4,146,179 A 3/1979 Egli et al.
4,144,012 A 5/1979 Pinkley
4,151,929 A 5/1979 Sapien
4,174,052 A 11/1979 Capra et al.
4,178,246 A 12/1979 Klein
4,224,958 A 9/1980 Kaplan et al.
4,260,183 A 4/1981 Krupp
4,264,282 A 4/1981 Crago
4,265,372 A 5/1981 Wainberg
4,325,419 A 4/1982 Gubitose
4,334,637 A 6/1982 Baker et al.
4,388,997 A 6/1983 Grime
4,395,968 A 8/1983 Wahnschaff et al.
4,505,669 A 3/1985 Rogers
4,545,504 A 10/1985 Fabel et al.
4,582,254 A 4/1986 Rotolico et al.
4,598,841 A 7/1986 Smiles
4,613,078 A 9/1986 Marshall
4,613,079 A 9/1986 Mains
4,641,764 A 2/1987 Faulkner, III
4,643,224 A 2/1987 Rung et al.
4,655,398 A 4/1987 Liggett
4,667,884 A 5/1987 Braziel
4,771,920 A 9/1988 Boccagno et al.
4,790,455 A 12/1988 Dieringer et al.
4,791,961 A 12/1988 Nitzberg et al.
4,798,571 A 1/1989 Everman et al.
4,820,052 A 4/1989 Krysel
4,834,587 A 5/1989 Crawley et al.
4,903,501 A 2/1990 Harl
5,044,555 A 9/1991 Youngeberg et al.
5,052,432 A 10/1991 Vonalt et al.
5,071,289 A 12/1991 Spivak
5,160,041 A 11/1992 Taniguchi et al.
5,161,450 A 11/1992 Ishikawa
5,220,521 A 6/1993 Kikinis
5,269,670 A 12/1993 Allen et al.
5,273,075 A 12/1993 Skaer
5,277,099 A 1/1994 Powers
5,318,198 A 6/1994 Micek et al.
5,330,106 A 7/1994 Braun, Jr.
5,366,353 A 11/1994 Hand
5,366,639 A 11/1994 Jones et al.
5,375,738 A 12/1994 Walsh et al.
5,378,089 A 1/1995 Law
5,399,014 A 3/1995 Takata et al.
5,445,195 A 8/1995 Kim
5,509,431 A 4/1996 Smith, Jr. et al.
5,533,650 A 7/1996 Conrad et al.
5,575,941 A 11/1996 Johnson
5,582,350 A 12/1996 Kosmyna et al.
5,584,666 A 12/1996 Kozumplik, Jr. et al.
5,598,974 A 2/1997 Lewis et al.
5,624,690 A 4/1997 Boldis et al.
5,649,813 A 7/1997 Able et al.
5,728,219 A 3/1998 Allen et al.
5,769,464 A 6/1998 DeBlasi et al.
5,791,830 A 8/1998 Fort et al.
5,794,847 A 8/1998 Stocker
5,816,501 A 10/1998 LoPresti et al.
5,820,022 A 10/1998 Fukano et al.
5,826,795 A 10/1998 Holland et al.
5,828,219 A 10/1998 Hanlon et al.
5,873,528 A 2/1999 Lewis et al.
5,875,922 A 3/1999 Chastine et al.
5,924,850 A 7/1999 French
5,942,170 A 8/1999 Peitz
5,967,429 A 10/1999 Ulfik et al.
5,996,902 A 12/1999 Morimoto et al.
6,009,606 A 1/2000 Voigtlaender et al.
6,024,123 A 2/2000 Weissfloch et al.
6,024,153 A 2/2000 Goldman
6,024,481 A 2/2000 Hillstrom et al.
6,032,690 A 3/2000 Weissfloch et al.
6,056,213 A 5/2000 Ruta et al.
6,089,471 A 7/2000 Scholl
6,095,803 A 8/2000 Slater
6,168,049 B1 1/2001 Bolyard, Jr.
6,196,275 B1 3/2001 Yazawa et al.
6,210,141 B1 4/2001 Allen
6,260,583 B1 7/2001 Flatt et al.
6,315,168 B1 11/2001 Bolyard, Jr. et al.
6,319,996 B1 11/2001 Burke et al.
6,364,520 B1 4/2002 Steele
6,378,782 B1 4/2002 Craine et al.
6,378,784 B1 4/2002 Allen et al.

(56) References Cited

U.S. PATENT DOCUMENTS

| | | | |
|---|---|---|---|
| 6,595,441 | B2 | 7/2003 | Petrie et al. |
| 6,619,569 | B2 | 9/2003 | Jens |
| 6,644,941 | B1 | 11/2003 | Able et al. |
| 6,666,258 | B1 | 12/2003 | Kono |
| 6,752,179 | B1 | 6/2004 | Schwartz |
| 6,776,361 | B1 | 8/2004 | Watanabe et al. |
| 6,796,514 | B1 | 9/2004 | Schwartz |
| 6,811,095 | B2 | 11/2004 | Donley et al. |
| 6,814,317 | B2 | 11/2004 | Watanabe et al. |
| 6,820,824 | B1 | 11/2004 | Joseph et al. |
| 6,883,960 | B2 | 4/2005 | Reeder et al. |
| 6,938,836 | B2 | 9/2005 | Bouic |
| 6,942,126 | B2 | 9/2005 | Douglas et al. |
| 6,953,155 | B2 | 10/2005 | Joseph et al. |
| 6,962,487 | B2 | 11/2005 | Caldwell |
| 6,971,590 | B2 | 12/2005 | Blette et al. |
| 7,032,839 | B2 | 4/2006 | Blette et al. |
| 7,070,653 | B2 | 7/2006 | Frost et al. |
| 7,083,119 | B2 | 8/2006 | Bouic et al. |
| 7,090,148 | B2 | 8/2006 | Petrie et al. |
| RE39,399 | E | 11/2006 | Allen |
| 7,143,960 | B2 | 12/2006 | Joseph et al. |
| 7,172,139 | B2 | 2/2007 | Bouic et al. |
| 7,172,337 | B2 | 2/2007 | Roszczenko et al. |
| 7,175,110 | B2 * | 2/2007 | Vicentini ..... B05B 7/2408 239/328 |
| 7,182,229 | B2 | 2/2007 | Gould et al. |
| 7,188,785 | B2 | 3/2007 | Joseph et al. |
| 7,201,336 | B2 | 4/2007 | Blette et al. |
| 7,270,249 | B1 | 9/2007 | Burkhead |
| 7,288,601 | B2 | 10/2007 | Nogi et al. |
| 7,296,919 | B2 | 11/2007 | Petersen et al. |
| 7,410,106 | B2 | 8/2008 | Escoto, Jr. et al. |
| 7,416,140 | B2 | 8/2008 | Camilleri et al. |
| 7,431,494 | B2 | 10/2008 | Zambaux |
| 7,513,443 | B2 | 4/2009 | Escoto, Jr. et al. |
| 7,575,633 | B2 | 8/2009 | Romanin |
| 7,614,529 | B2 | 11/2009 | Bolyard, Jr. et al. |
| 7,626,143 | B2 | 12/2009 | Miller |
| 7,699,243 | B2 | 4/2010 | Starke |
| 7,712,682 | B2 | 5/2010 | Joseph et al. |
| 7,713,519 | B2 | 5/2010 | Bonda et al. |
| 7,766,250 | B2 * | 8/2010 | Kosmyna ..... B05B 7/2408 239/328 |
| 7,770,760 | B2 | 8/2010 | McGuffey et al. |
| 7,789,324 | B2 | 9/2010 | Bouic et al. |
| 7,798,425 | B2 | 9/2010 | Joseph et al. |
| 7,798,426 | B2 | 9/2010 | Joseph et al. |
| 7,798,427 | B2 | 9/2010 | Joseph et al. |
| 7,819,253 | B2 | 10/2010 | Borger et al. |
| 7,857,173 | B2 | 12/2010 | Bolyard, Jr. |
| D630,708 | S | 1/2011 | Blenkush et al. |
| 7,870,891 | B2 | 1/2011 | Rule |
| D633,176 | S | 2/2011 | Blenkush et al. |
| 7,886,935 | B2 | 2/2011 | Lasko |
| 7,905,358 | B2 | 3/2011 | Backes et al. |
| 7,971,806 | B2 | 7/2011 | Johnson et al. |
| 8,005,417 | B2 | 8/2011 | Hattori et al. |
| 8,069,653 | B2 | 12/2011 | Ganzer |
| 8,079,158 | B2 | 12/2011 | Ekart et al. |
| 8,118,070 | B2 | 2/2012 | Smith |
| 8,152,362 | B2 | 4/2012 | Uhlenkamp et al. |
| 8,225,963 | B2 | 7/2012 | Mehaffy et al. |
| 9,796,492 | B2 * | 10/2017 | Luczak ..... B05B 3/006 |
| 2003/0006311 | A1 | 1/2003 | Rothrum et al. |
| 2003/0021181 | A1 | 1/2003 | Maguire |
| 2003/0183655 | A1 | 10/2003 | Padar |
| 2004/0251269 | A1 | 12/2004 | Gosis et al. |
| 2005/0085620 | A1 | 4/2005 | Bruckmann |
| 2005/0095359 | A1 | 5/2005 | Pallante et al. |
| 2005/0238514 | A1 | 10/2005 | Hagin |
| 2006/0175433 | A1 | 8/2006 | Escoto, Jr. et al. |
| 2006/0255072 | A1 | 11/2006 | Hagin et al. |
| 2007/0080157 | A1 | 4/2007 | Mehaffy et al. |
| 2007/0138320 | A1 | 6/2007 | Timmes et al. |
| 2008/0217360 | A1 | 9/2008 | MacLean et al. |
| 2009/0095730 | A1 | 4/2009 | Ganzer et al. |
| 2009/0110813 | A1 | 4/2009 | Zimmerman et al. |
| 2009/0266844 | A1 | 10/2009 | McGuffey |
| 2009/0285983 | A1 | 11/2009 | Baldauf et al. |
| 2009/0288403 | A1 | 11/2009 | Behrens et al. |
| 2010/0089012 | A1 | 4/2010 | Duckworth et al. |
| 2010/0255526 | A1 | 10/2010 | Braet et al. |
| 2010/0288772 | A1 | 11/2010 | Wambeke et al. |
| 2011/0079663 | A1 | 4/2011 | Cabrera |
| 2011/0192866 | A1 | 8/2011 | Shaw |
| 2011/0198413 | A1 | 8/2011 | Thompson et al. |
| 2011/0206469 | A1 | 8/2011 | Furuyama et al. |
| 2012/0045352 | A1 | 2/2012 | Lawyer et al. |
| 2012/0060511 | A1 | 3/2012 | Zuo et al. |
| 2012/0107059 | A1 | 5/2012 | Howland et al. |
| 2013/0105598 | A1 * | 5/2013 | Shultz ..... B05B 9/043 239/328 |

FOREIGN PATENT DOCUMENTS

| | | | |
|---|---|---|---|
| EP | 0678334 | A2 | 10/1995 |
| EP | 0718234 | A2 | 6/1996 |
| EP | 0847809 | A1 | 6/1998 |
| EP | 0993873 | A2 | 4/2000 |
| EP | 1772196 | A1 | 4/2007 |
| JP | S63100439 | A | 5/1988 |
| JP | H04500063 | A | 1/1992 |
| JP | H07289968 | A | 11/1995 |
| JP | H0889872 | A | 4/1996 |
| JP | 2007000837 | A | 1/2007 |
| JP | 2008006361 | A | 1/2008 |
| JP | 6058282 | B2 | 1/2017 |
| WO | WO8100220 | A1 | 2/1981 |
| WO | 8907499 | A1 | 8/1989 |
| WO | 0115836 | A1 | 3/2001 |
| WO | 2004037431 | A1 | 5/2004 |
| WO | WO20070149760 | A2 | 12/2007 |

OTHER PUBLICATIONS

International Search Report and Written Opinion, for PCT Patent Application No. PCT/US2012/061859, dated Feb. 28, 2013.

Second Chinese Office Action, for Chinese Patent Application No. 201280052618.1, dated May 5, 2016, 14 pages.

First Taiwanese Office Action, for Taiwanese Patent Application No. 101139819, dated Jul. 4, 2016, 14 pages.

Third Chinese Office Action & Search Report, for Chinese Patent Application No. 2012800526181, dated Nov. 16, 2016, 3 pages.

Australian Patent Examination Report No. 1, for Australian Patent Application No. 2012328773, dated Aug. 3, 2016, 4 pages.

European Search Report, EP Application Serial No. 12844491, dated Jul. 17, 2015, 6 pages.

State Intellectual Property Office of People's Republic of China, First Office Action, Application No. 201280052618.1, dated Sep. 21, 2015, 2 pages.

Chinese Office Action of Chinese Patent Application No. 2017106763880, dated Nov. 28, 2018, 19 pages.

* cited by examiner

MANUAL CHECK VALVE FOR PRIMING A COLLAPSIBLE FLUID LINER FOR A SPRAYER

CROSS-REFERENCE TO RELATED APPLICATION(S)

This application is a continuation of U.S. application Ser. No. 14/656,138 filed Mar. 12, 2015 for "MANUAL CHECK VALVE FOR PRIMING A COLLAPSIBLE FLUID LINER FOR A SPRAYER" by Mariusz J. Luczak. The aforementioned U.S. application Ser. No. 14/656,138 is hereby incorporated by reference in its entirety.

BACKGROUND

The present invention relates generally to liquid sprayers, and specifically to priming valves for priming the fluid supply of a liquid sprayer.

Paint sprayers are well known and commonly used to paint various surfaces. Airless paint sprayers provide the highest-quality finish due to the ability to finely atomize liquid paint. To ensure a high-quality finish from an airless paint sprayer, air cannot be allowed to enter the pumping mechanism of the paint sprayer. Typically, the fluid supply is included in a rigid container and a suction hose is provided within the container. Air then replaces the volume of liquid sprayed throughout the spraying process. The suction hose generally extends to the bottom of the container from the pumping mechanism to allow as much fluid as possible to be sprayed before air begins to enter the suction hose. Alternatively, to ensure that air does not enter the fluid supply, a collapsible liner for holding the liquid to be sprayed can be used, as described in U.S. application Ser. No. 13/660,248 titled Sprayer Fluid Supply with Collapsible Liner, which is hereby incorporated by reference. When a collapsible liner is used, air is purged from the collapsible liner to prime the fluid supply.

SUMMARY

A fluid supply for a liquid sprayer includes a collapsible liner for holding a liquid, a cup for supporting the collapsible liner, a lid for connecting to the cup to secure the collapsible liner relative to the lid and the cup, and a manual check valve attached to the lid. The manual check valve includes a chamber, a closure, and an orifice extending between the collapsible liner and the chamber.

DETAILED DESCRIPTION

Figure 1:
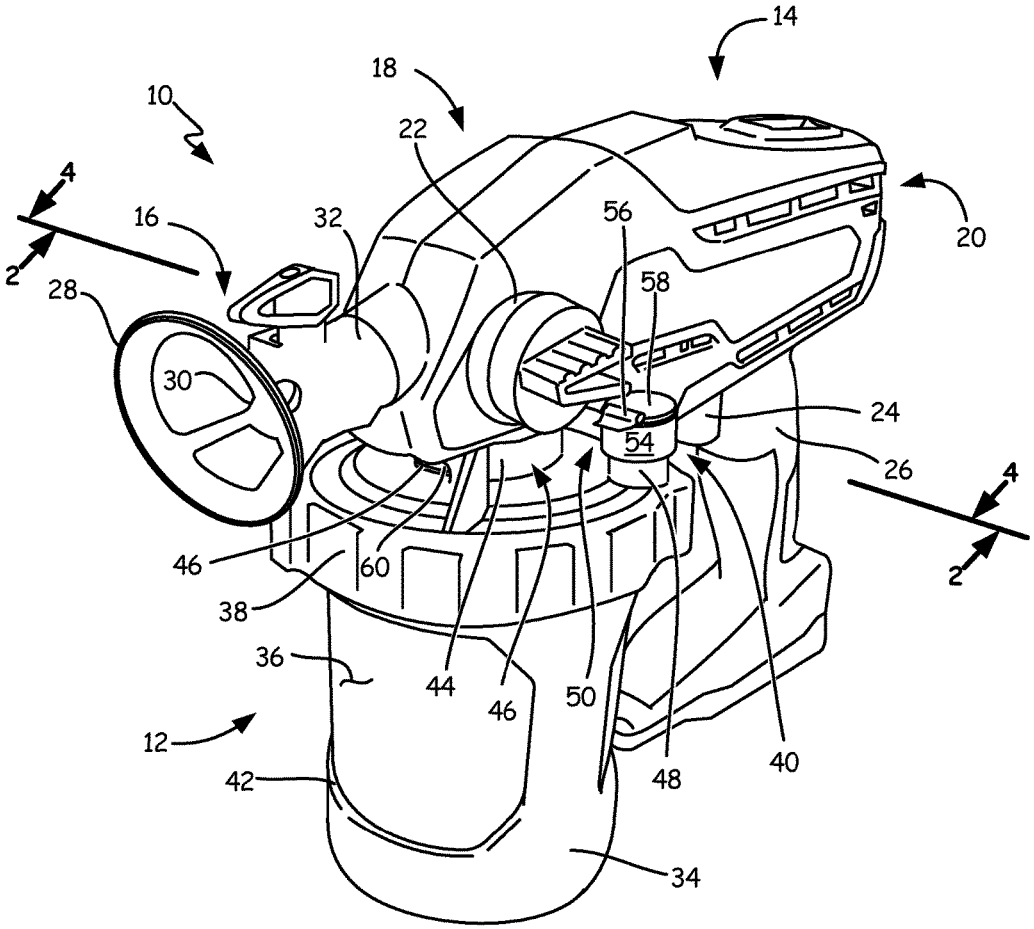
FIG. 1 is a side perspective view of a spray gun with a fluid supply.

FIG. 1 shows a side perspective view of a portable airless spray gun 10 and fluid supply 12. Spray gun 10 includes housing 14, spray tip assembly 16, pumping mechanism 18, and drive element 20. Spray gun 10 also includes priming valve 22 and trigger 24. Housing 14 includes integrated handle 26. Spray tip assembly 16 includes guard 28, spray tip 30, and connector 32. Fluid supply 12 includes cup 34, collapsible liner 36, lid 38, and manual check valve 40. Cup 34 includes cut-out section 42, and lid 38 includes neck portion 44 and connecting slots 46. Manual check valve 40 includes chamber 48, closure 50, and orifice 52 (shown in FIG. 2). In this embodiment, closure 50 is a hinged cap and includes attachment portion 54, hinge 56, and top portion 58.

Collapsible liner 36 is secured within cup 34 and between cup 34 and lid 38. Cup 34 is removably secured to lid 38. Collapsible liner 36 is fabricated from a flexible material, such as low density polyethylene, to allow collapsible liner 36 to deform as pumping mechanism 18 draws fluid from collapsible liner 36. Cup 34 includes cut-out section 42 to allow access to collapsible liner 36 when collapsible liner 36 is secured within cup 34. Chamber 48 is integral with lid 38, and chamber 48 projects vertically from lid 38. Closure 50 is releasably attached to chamber 48.

Pumping mechanism 18 and drive element 20 are disposed within housing 14. Connector 32 couples spray tip assembly 16 to pumping mechanism 18. Fluid supply 12 is secured to pumping mechanism 18 by tabs 60 that engage connecting slots 46 in neck portion 44. Pumping mechanism 18 protrudes through lid 38 and receives fluid from collapsible liner 36. Guard 28 is attached to connector 32 to prevent objects from directly contacting fluid exiting spray tip 30 at high velocity.

Fluid supply 12 is primed by squeezing collapsible liner 36 through cut-out portion 42 with closure 50 removed or left in an open position. When collapsible liner 36 is squeezed, air exits collapsible liner 36 through orifice 52 and chamber 48. Once air has been purged from collapsible liner 36, closure 50 is positioned to seal an upper opening of chamber 48.

Spray gun 10 is activated by pulling trigger 24. Drive element 20 engages pumping mechanism 18, and pumping mechanism 18 draws liquid from collapsible liner 36. Collapsible liner 36 continues collapsing as liquid is drawn out of collapsible liner 36. When spray gun 10 is in use, closure 50 seals an upper opening of chamber 48 to prevent any air from reentering collapsible liner 36 through orifice 52. The liquid is sprayed through spray tip 30 at high velocity and applied to a desired surface.

Figure 2:
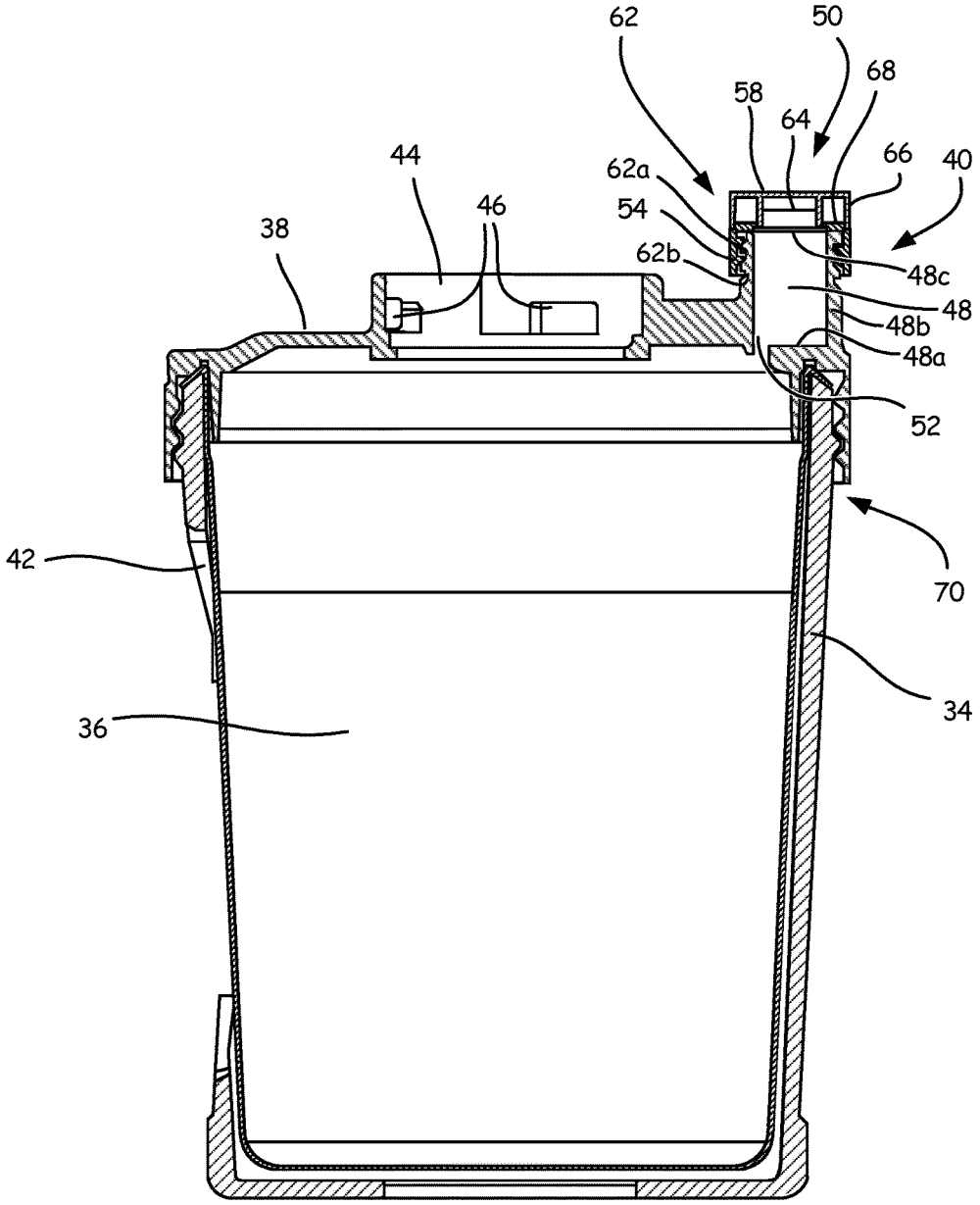
FIG. 2 is a side elevation, cross-sectional view along section 2-2 in FIG. 1 of a fluid supply.

FIG. 2 is a side elevation, cross-sectional view of fluid supply 12. Fluid supply 12 includes cup 34, collapsible liner 36, lid 38, and manual check valve 40. Cup 34 includes cut-out portion 42, and lid 38 includes neck portion 44 and connecting slots 46. Manual check valve 40 includes chamber 48, closure 50, and orifice 52.

Chamber 48 is defined by floor 48*a* (which contains orifice 52), sidewall 48*b*, and upper opening 48*c*. Closure 50 is used to manually open and close manual check valve 40. In the closed position, closure 50 covers and seal seals upper opening 48*c* of chamber 48.

In the present embodiment, closure 50 is a hinged cap and includes attachment portion 54, hinge 56 (shown in FIG. 1), and top portion 58. Although closure 50 is shown as a hinged cap, other embodiments of closure 50 include a press fit plug or a screw on cap. Attachment portion 54 includes threads 62A on an inner surface of attachment portion 54, and chamber 48 includes threads 62B on an outer surface of chamber 48. Top portion 58 includes first annular portion 64 extending inwardly from an inner surface of top portion 58 and second annular portion 66 integral with an edge of top portion 58. Closure 50 further includes annular ridge 68 extending from a top of attachment portion 54.

Collapsible liner 36 is secured within cup 34 when lid 38 is secured to cup 34 at connection 70. Connection 70 is shown as a press-fit connection in FIG. 2. Chamber 48 is integral with lid 38 and extends vertically from lid 38. Orifice 52 extends through lid 38 to provide a fluid passageway from collapsible liner 36 to chamber 48. Orifice 52 can have a diameter between about 0.508 millimeters (mm) (0.020 inches) and about 1.778 mm (0.070 inches). More preferably, orifice 52 has a diameter of about 1.016 mm (0.040 inches). Closure 50 is secured to chamber 48 at connection 62. In the present embodiment, attachment portion 52 is secured to chamber 48 by threads 62A engaging threads 62B. While connection 62 is shown as a threaded connection, connection 62 may include mechanical snap connections, press fit connections, or any other suitable connecting mechanism.

Collapsible liner 36 is filled with a liquid and collapsible liner 36 is secured within cup 34. Collapsible liner 36 is secured in place by attaching lid 38 to cup 34. To prime fluid supply 12 for spraying, air is forced out of collapsible liner 36 by squeezing collapsible liner 36 through cut-out portion 42 in cup 34. The air is forced out of collapsible liner 36 through orifice 52, and when the air has been expelled from collapsible liner 36, the liquid begins to exit through orifice 52 and into chamber 48. Orifice 52 is sized so air can easily flow out of collapsible liner 36 through orifice 52, but liquid encounters more resistance when flowing through orifice 52, which causes a significant increase in the force required to continue expelling fluid from fluid supply 12. The force increase required to squeeze liquid through orifice 52 signals the user to close closure 50.

In the current embodiment, when closure 50 is sealed, top portion 58 is secured to attachment portion 54. Sealing closure 50 prevents air from reentering collapsible liner 36 through chamber 48 while spray gun 10 is in use. Capturing expelled liquid in chamber 48 prevents the liquid from leaking onto lid 38 and keeps the priming operation clean, which allows spray gun 10 to be used in any position, including upside down, without worrying about liquid leaking through orifice 52.

Figure 3A:
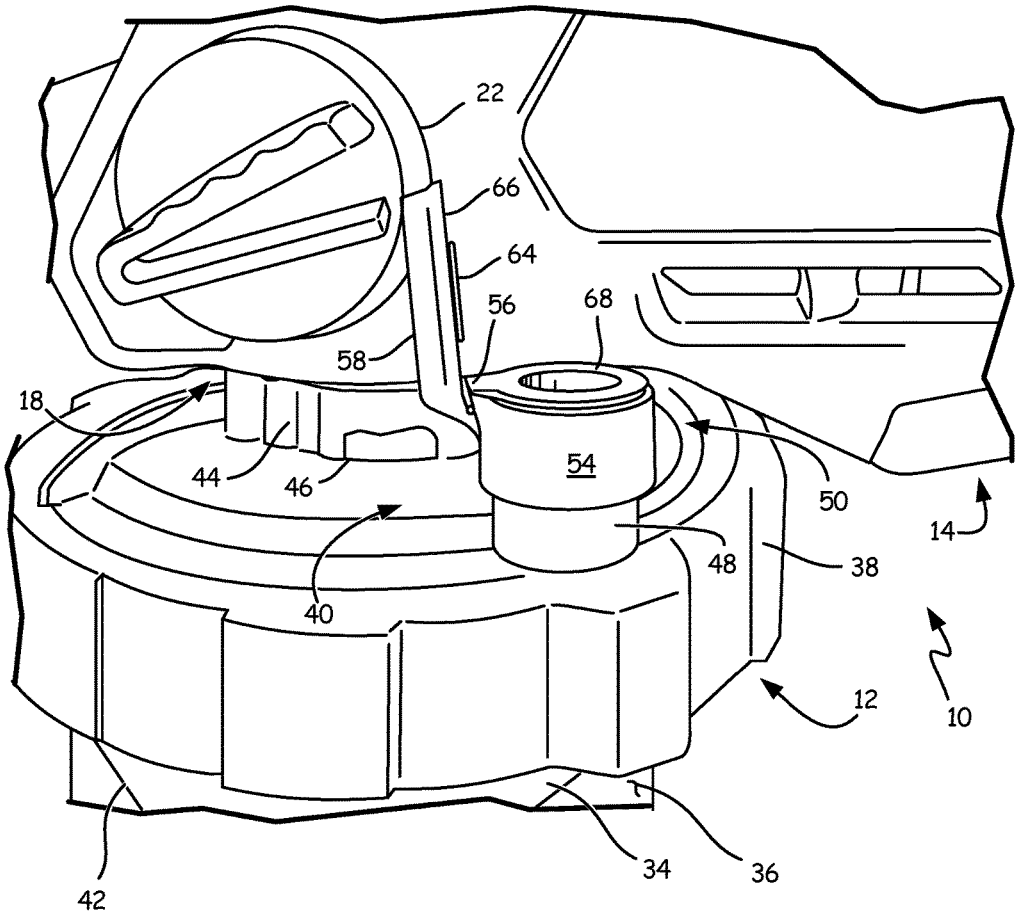
FIG. 3A shows a side perspective view of a spray gun with a fluid supply and with a closure in an open position.
Figure 3B:
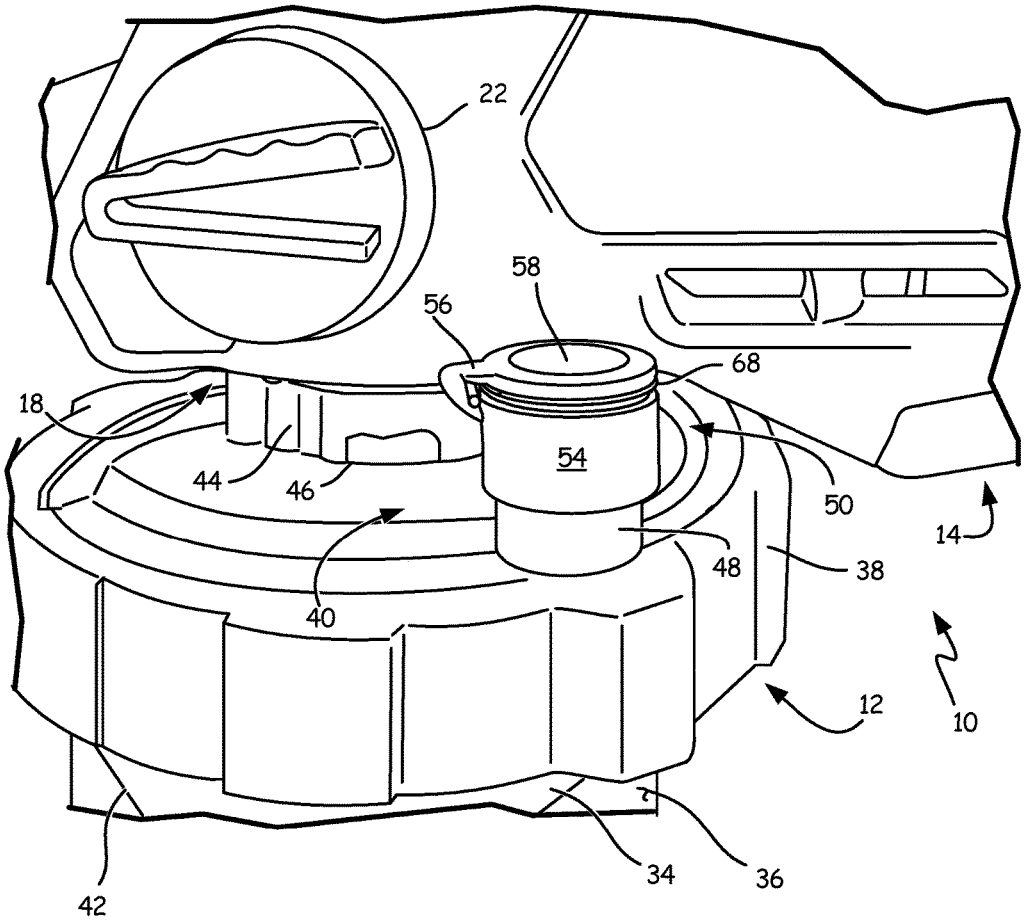
FIG. 3B shows a side perspective view of a spray gun with a fluid supply and with a closure in a sealed position.

FIG. 3A is a side perspective view of spray gun 10 and fluid supply 12 with closure 50 in an open position. FIG. 3B is a side perspective view of spray gun 10 and fluid supply 12 with closure 50 in a sealed position. FIGS. 3A and 3B will be discussed together. A portion of spray gun 10 is shown, which includes housing 14, pumping mechanism 18 disposed within housing 14, and priming valve 22. Fluid supply 12 includes cup 34, collapsible liner 36, lid 38, and manual check valve 40. Cup 34 includes cut-out portions 42. Lid 38 includes neck portion 44 and connecting slots 46. Manual check valve 40 includes chamber 38, closure 50, and orifice 52. In the present embodiment, closure 50 includes attachment portion 54, hinge 56, and top portion 58. Top portion 58 includes first annular portion 64 extending inwardly from an inner surface of top portion 58 and second annular portion 66 integral with an edge of top portion 58. Attachment portion 54 includes annular ridge 68.

Collapsible liner 36 is secured within cup 34 by affixing lid 38 to cup 34. Chamber 48 is integrally connected to an upper surface of lid 38 and projects vertically from the upper surface of lid 38. Orifice 52 extends through lid 38 and provides a connection between collapsible liner 36 and chamber 48. Closure 50 is removably secured to chamber 48 via connection 62. In the present embodiment, closure 50 is secured by connecting attachment portion 54 to chamber 48. Hinge 56 connects top portion 58 to attachment portion 54. Fluid supply 12 is secured to spray gun 10 by tabs 60 that engage connecting slots 46 through neck portion 44.

In the present embodiment, when priming fluid supply 12, top portion 58 of closure 50 is in the open position (FIG. 3A). After air has been purged from collapsible liner 36, top portion 58 is moved from the open position to the closed position (FIG. 3B). When closure 50 is sealed, annular ridge 66 is received between first annular portion 62 and second annular portion 64, which seals chamber 48. Sealing chamber 48 prevents air from being introduced into collapsible liner 36 during spraying, which helps ensure that the spray gun 10 provides an even finish. In addition, sealing chamber 48 prevents any liquid disposed in chamber 48 from leaking onto another surface of spray gun 10.

Figure 4A:
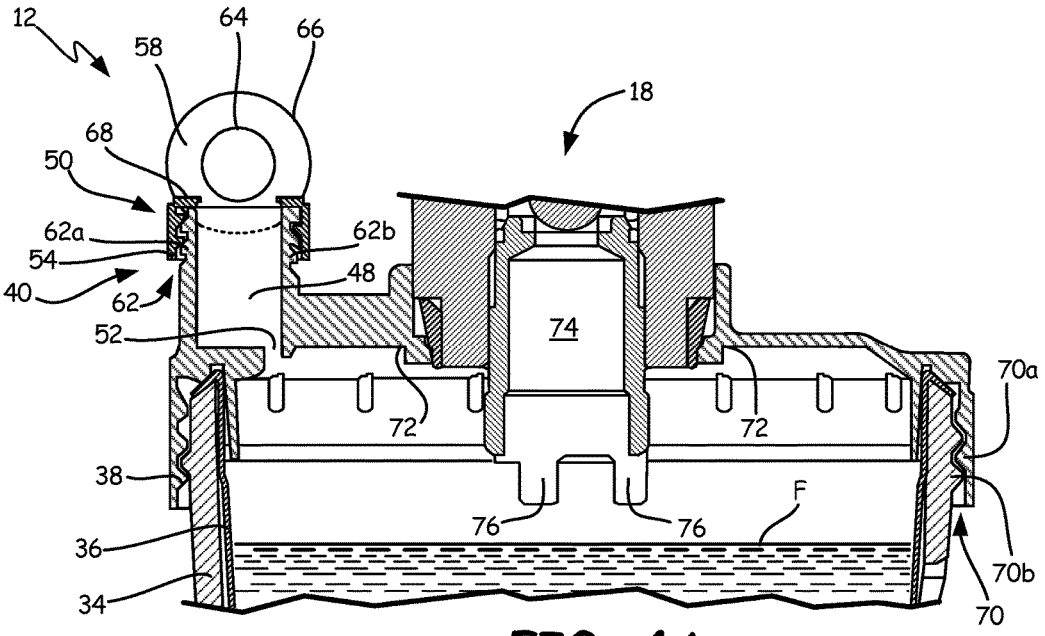
FIG. 4A depicts a cross-sectional view, along section 4-4 in FIG. 1, of the connection between a fluid supply and a pumping mechanism of a spray gun before priming.
Figure 4B:
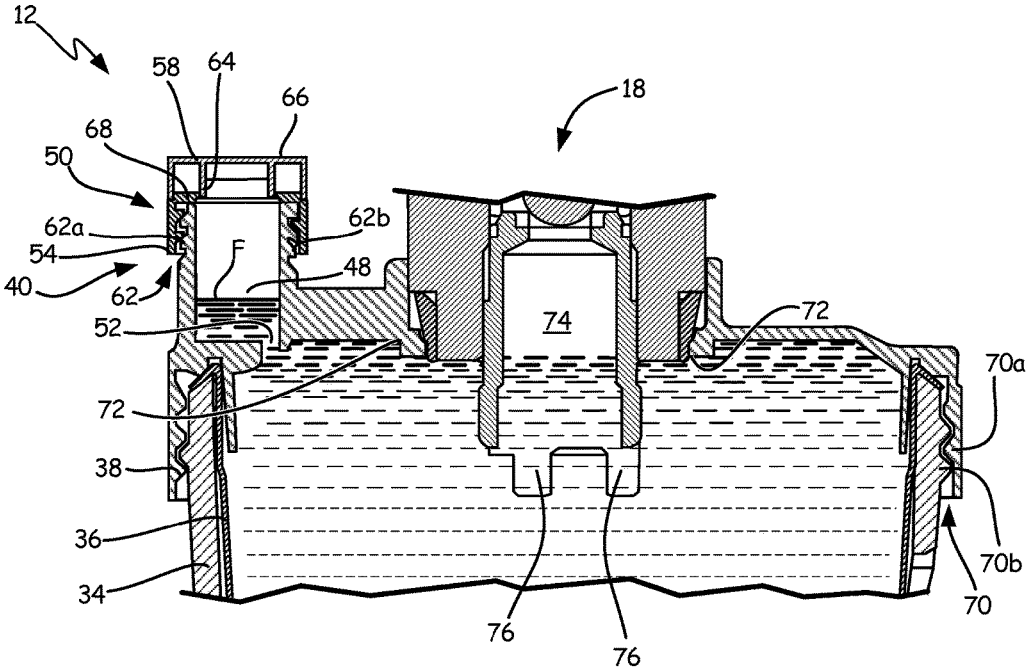
FIG. 4B is a cross-sectional view along section 4-4 showing the connection of FIG. 4A after priming the fluid supply and sealing the chamber.

FIG. 4A depicts a cross-sectional view of the connection between fluid supply 12 and pumping mechanism 18, and shows fluid line F before priming fluid supply 12. FIG. 4B depicts the cross-sectional view of FIG. 4A after priming fluid supply 12. Fluid supply 12 includes cup 34, collapsible liner 36, lid 38, and manual check valve 40. Cup includes threads 70B. Lid 38 includes neck portion 44 having connecting slots 46, threads 70A and lip 72. Manual check valve 40 includes chamber 48, closure 50, and orifice 52. Closure 50 includes attachment portion 54, hinge 56, and top portion 58. Top portion 58 includes first annular portion 64 extending inwardly from an inner surface of top portion 58 and second annular portion 66 integral with an edge of top portion 58. Closure 50 further includes annular ridge 68 arranged at a top of attachment portion 54. A portion of pumping mechanism 18 is shown and includes suction tube 74 and extensions 76.

Collapsible liner 36 is secured within cup 34 and between lid 38 and cup 34. Cup 34 is secured to lid 38 at connection 70. Connection 70 includes threads 70A on an inner portion of lid 38 and complementary threads 70B on an outer portion of cup 34. Although connection 70 is shown as a threaded connection, connection 70 may include mechanical snap connections, press fit connections, or any other suitable connecting mechanism. When fluid supply 12 is attached to pumping mechanism 18, lip 72 sealingly engages pumping mechanism 18 such that air or liquid in collapsible liner 36 must exit collapsible liner 36 through orifice 52 and into chamber 48 during priming. Closure 50 is releasably secured to chamber 48 at connection 62. In the embodiment shown, connection 62 includes threads 62A on an inner area of attachment portion 54 and threads 62B on an outer area of chamber 48.

Collapsible liner 36 is filled with the liquid to be sprayed and collapsible liner 36 is secured within cup 36 by affixing lid 38 to cup 36 at connection 70. Fluid supply 12 is secured to pumping mechanism 18 by tabs 60 engaging connecting slots 46. To prime fluid supply 12 before use, collapsible liner 36 is squeezed through cut-out portion 42 to force air out of collapsible liner 36 through orifice 52 and chamber 48. When fluid level F rises to the level that liquid begins to enter chamber 48 through orifice 52, closure 50 is closed to seal chamber 48 (FIG. 4B). Sealing closure 50 keeps fluid supply 12 primed by preventing air from entering collapsible liner 36 as collapsible liner 36 continues collapsing during use. Sealing closure 50 also prevents liquid in chamber 48 from spilling onto another surface of spray gun 10. Extensions 76 on suction tube 74 prevent collapsible liner 36 from being sucked into suction tube 74 when spray gun 10 is in use. If collapsible liner 36 were to be sucked into suction tube 74, it may clog suction tube 74, preventing fluid from entering pumping mechanism 18.

The manual check valve described herein provides several advantages. Manual check valve 40 provides chamber 48 for liquid to be contained in without spilling onto other surfaces, preventing any messy cleanup. In addition, orifice 52 is large enough that it will not become clogged, but if orifice 52 does become clogged it can easily be cleared by passing an object, such as a pipe-cleaner, though orifice 52. Orifice 52 allows the same fluid supply 12 to be reused by the user, which reduces the user's costs because a new lid does not have to be used for each spraying job. The small diameter of orifice 52 allows air to easily be expelled from collapsible liner 36, but the diameter prevents liquid from quickly entering chamber 48 and increases the amount of force that the user must apply to continue pushing liquid out of collapsible liner 36 after the air has been expelled. This increase in force notifies the user to seal closure 50 and prevents the liquid from overflowing chamber 48 before the user can seal closure 50.

Closure 50 prevents air from entering collapsible liner 36 through orifice 52 during use. Additionally, closure 50 is removable from chamber 48, which allows the user to transfer closure 50 between various fluid supplies 12, decreasing the user's costs. A removable closure 50 also allows the user to replace closure 50 if it becomes worn out due to excessive use without having to replace the entire fluid supply 12.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A fluid supply for a liquid sprayer, the fluid supply comprising:

a cup, the cup having at least one cut-out section through a wall of the cup;

a lid removably attached to the cup;

a collapsible liner disposed in the cup, wherein the collapsible liner is configured to hold a liquid, and wherein a portion of the collapsible liner is captured between the lid and the cup such that the connection of the lid and the cup secures the collapsible liner between the lid and the cup and seals an interior of the collapsible liner;

wherein the cut-out section is configured to provide access to the collapsible liner from the exterior of the cup;

a manual check valve attached to the lid, the manual check valve comprising:

a chamber for trapping fluid released from the collapsible liner comprising a floor, a sidewall extending from the floor, and an upper opening;

an orifice extending through the lid and the floor and between the collapsible liner and the chamber; and a closure for sealing the upper opening of the chamber to prevent air from reentering the chamber.

2. The fluid supply of claim 1, wherein the orifice is circular with a diameter of about 0.020 inches to about 0.070 inches or any shape with equivalent area.

3. The fluid supply of claim 2, wherein the closure comprises a press-fit plug.

4. The fluid supply of claim 2, wherein the closure comprises:

a circular top portion comprising an inner surface, an outer surface opposite the inner surface, and an edge;

a cylindrical attachment portion comprising a receiving wall having an inner portion and an outer portion, an upper opening, and a lower opening for receiving the sidewall of the chamber.

5. The fluid supply of claim 4, wherein the attachment portion further comprises:

a first set of threads on the inner portion of the receiving wall; and wherein the sidewall of the chamber further comprises a second set of threads on an outer surface of the sidewall for receiving the first set of threads.

6. The fluid supply of claim 4, wherein the top portion is integral with an upper edge of the receiving wall.

7. The fluid supply of claim 4, wherein the closure further comprises:

a first annular portion extending from the inner surface of the circular top portion;

a second annular portion extending from the edge of the circular top portion; and an annular ridge extending from an edge of the upper opening of the attachment portion.

8. The fluid supply of claim 7, wherein the closure further comprises:

a radial seal affixed to a free end of the second annular portion.

9. The fluid supply of claim 7, wherein the top portion is hingedly connected to the attachment portion.

10. A sprayer comprising:

a spray gun; and the fluid supply of claim 1 mounted to the spray gun and configured to hold liquid prior to spraying by the spray gun.

11. The sprayer of claim 10, wherein the sprayer comprises a motorized handheld sprayer.

12. The sprayer of claim 11, further comprising a pumping mechanism configured to draw the liquid from the collapsible liner and eject the liquid from a spray tip of the spray gun.

13. The sprayer of claim 12, wherein the pumping mechanism is a piston pump.

14. A fluid supply for a liquid sprayer, the fluid supply comprising:

a container, the container having at least one cut-out section through a wall of the container;

a cap removably attached to the container;

a collapsible liner disposed in the container;

wherein the collapsible liner is configured to hold a liquid;

wherein a portion of the collapsible liner is captured between the cap and the cup such that the connection of the cap and the cup secures the collapsible liner between the cap and the cup and seals an interior of the collapsible liner; and wherein the cut-out section is configured to provide access to the collapsible liner from the exterior of the cup such that the collapsible liner can be compressed to purge air from the collapsible liner;

a manual check valve attached to the cap, the manual check valve comprising a closure for sealing an upper opening of the manual check valve to prevent air from reentering the manual check valve.

15. The fluid supply of claim 14, further comprising:

a liquid sprayer having a pump;

a flowpath extending through the cap into the collapsible liner, the flowpath configured to route fluid from the collapsible liner to an intake of the pump.

16. The fluid supply of claim 15, wherein the liquid sprayer is a motorized handheld sprayer.

17. The fluid supply of claim 16, wherein the pump is a piston pump.

18. The fluid supply of claim 14, wherein the manual check valve further comprises:

a chamber for trapping fluid released from the collapsible liner comprising a floor, a sidewall extending from the floor, and the upper opening;

an orifice extending through the cap and the floor and between the collapsible liner and the chamber.

19. The fluid supply of claim 18, wherein the orifice is sized such that liquid encounters resistance when flowing through the orifice.

* * * * *